US007224107B2

(12) United States Patent
Moench et al.

(10) Patent No.: US 7,224,107 B2
(45) Date of Patent: May 29, 2007

(54) ILLUMINATION UNIT

(75) Inventors: Holger Moench, Vaals (NL); Arnd Ritz, Heinsberg (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 263 days.

(21) Appl. No.: 10/492,584

(22) PCT Filed: Oct. 15, 2002

(86) PCT No.: PCT/IB02/04246

§ 371 (c)(1),
(2), (4) Date: Apr. 14, 2004

(87) PCT Pub. No.: WO03/033959

PCT Pub. Date: Apr. 24, 2003

(65) Prior Publication Data

US 2005/0024880 A1 Feb. 3, 2005

(30) Foreign Application Priority Data

Oct. 17, 2001 (DE) ..... 101 51 267

(51) Int. Cl.
*H01J 5/16* (2006.01)
*H01J 61/35* (2006.01)
*F21V 7/00* (2006.01)

(52) U.S. Cl. ..... 313/114; 313/635; 362/346; 362/517

(58) Field of Classification Search ..... 313/634, 313/114, 635; 362/346, 517
See application file for complete search history.

(56) References Cited

U.S. PATENT DOCUMENTS

| | | | | |
|---|---|---|---|---|
| 1,153,446 | A * | 9/1915 | Roffy | 362/302 |
| 3,253,504 | A * | 5/1966 | Vollmer | 353/55 |
| 3,796,886 | A * | 3/1974 | Freeman | 250/493.1 |
| 3,835,342 | A * | 9/1974 | Freeman | 313/114 |
| 4,305,099 | A * | 12/1981 | True et al. | 348/759 |
| 4,891,542 | A * | 1/1990 | Mellor et al. | 313/112 |
| 4,935,668 | A * | 6/1990 | Hansler et al. | 315/82 |
| 5,067,053 | A * | 11/1991 | Akizuki | 362/518 |
| 5,220,237 | A * | 6/1993 | Maseki et al. | 313/113 |
| 5,479,065 | A * | 12/1995 | Sugimoto et al. | 313/113 |
| 5,491,525 | A * | 2/1996 | Yamasaki et al. | 353/98 |
| 6,212,004 | B1 * | 4/2001 | Stachowiak et al. | 359/360 |
| 6,616,304 | B2 * | 9/2003 | Li | 362/302 |
| 6,866,404 | B2 * | 3/2005 | Yamauchi et al. | 362/299 |

* cited by examiner

*Primary Examiner*—Edward J. Glick
*Assistant Examiner*—Thomas R. Artman

(57) ABSTRACT

An illumination unit has a light source, in particular a high-intensity discharge lamp or an ultra high performance lamp, a main reflector and a back reflector with an aperture opposite the main reflector. Light is reflected from the light source through the aperture onto the main reflector. The centers of the light source and the back reflector are located or shaped relative to each other such that a first sector angle (L2–L2') enclosed between the light source center and the edge of the back reflector aperture is smaller than 180°. The efficiency of light emission is considerably increased. Preferred embodiments, each of which can cause a further increase in light output, relate to various shapes of the back reflector and the inner walls of the gas discharge space, as well as to the shape of the part of the glass bulb that surrounds the gas discharge space.

25 Claims, 2 Drawing Sheets

ILLUMINATION UNIT

The invention relates to an illumination unit having a light source, in particular a light source in the form of a high-intensity discharge (HID) lamp or an ultra high performance (UHP) lamp, as well as a main reflector and a back reflector, the light from the light source being reflected onto the main reflector through an aperture in the back reflector that is positioned opposite the main reflector.

Because of their optical properties, illumination units of this type are preferably used, among other things, for projection purposes. In particular, so-called short-arc HID lamps are used for this purpose, with relatively close spacing between electrode tips, so that the actual light source (arc) is essentially point-shaped.

An illumination unit for liquid crystal projection devices is known from U.S. Pat. No. 5,491,525, having a main reflector, a light source, for example a discharge lamp, as well as a back reflector that surrounds the light source essentially like a hemisphere and reflects light from the light source on to the main reflector. Moreover, various filters, dichroic reflecting layers as well as lens arrays are provided in order to influence the path of rays of the emitted light in a certain way and to increase the brightness on a projection surface.

It is an object of the invention to create an illumination unit of the above mentioned type, which, by comparison, has a much increased efficiency (lumen output) as well as improved optical properties and performance capabilities.

It is also intended to create an illumination unit with a further improved focusing of the emitted light.

Moreover, it is intended to create an illumination unit that provides improved focusing of the emitted light even for reflectors that are non-circular in plan view (i. e. viewed in the direction opposite to that of light emission), for example rectangular or shaped in some other way.

Finally, it is intended to create an illumination unit whose light focusing is improved even if the glass bulb of a discharge lamp that is used as a light source has relatively thick walls, such as those necessary, for example, for high-pressure short-arc lamps.

An illumination unit of the type mentioned in the opening paragraph achieves this object when, for example, the center of the light source and the back reflector are located or shaped relative to each other such that a first sector angle enclosed between the light source center and the edge of the back reflector aperture is smaller than 180°.

The center of the light source is here defined as the region in which the essential or largest part of light is generated.

An advantage of this solution consists in the complete or at least near-complete avoidance of multiple reflections from the back reflector (this depends on the size of the light source and also on whether all sector angles generated by completely circumscribing the edge of the back reflector aperture are smaller than 180°), so that the light output can be considerably improved.

Other advantageous of further embodiments include increased light output; avoiding lateral emission of light from the illumination unit; reduced increases in temperature of the glass bulb caused by the back reflector; and elimination or reduction of lens effects or other disadvantageous influences on the paths of rays of the generated light, even if the part of the glass bulb wall surrounding the gas discharge space is relatively thick. In addition, light in certain spectral ranges can be emitted preferentially. Suitable materials can be used in order to generate a dichroic reflection, allowing for suitably adapted expansion coefficients.

Further particulars, characteristics, and advantages of the invention will become clear from the ensuing description of preferred embodiments which is given with reference to the drawing, in which.

The embodiments described below are especially suitable for use in projection systems.

Figure 1:
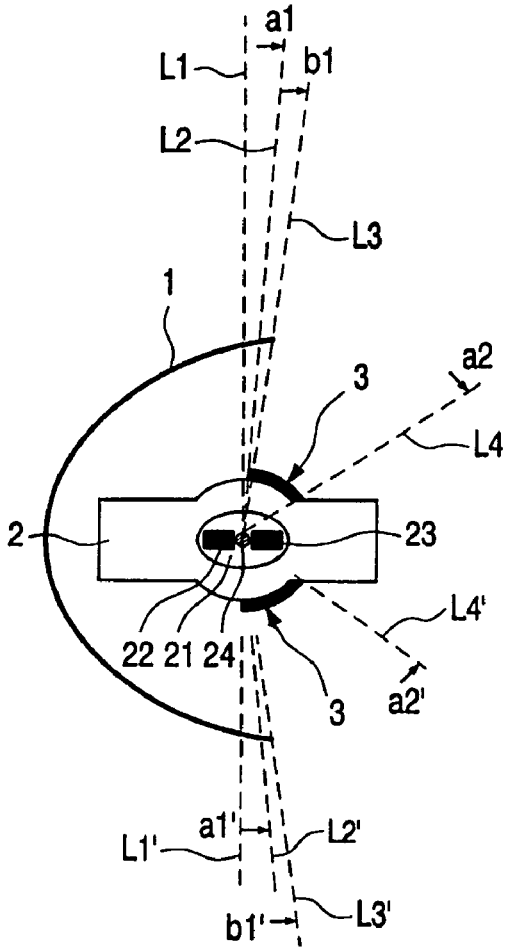
FIG. 1 is a diagrammatic longitudinal sectional view of a first embodiment.

The first embodiment of the illumination unit according to the invention comprises, as can be seen in FIG. 1, a main reflector, which has essentially the shape of a parabolic mirror or an ellipsoidal shape or some other longitudinal section, which is chosen in accordance with the focusing required for a particular application.

Furthermore, FIG. 1 shows as an essential part of a gas discharge lamp the glass bulb 2 having a discharge space 21, which contains a discharge gas and an electrode arrangement. The electrode arrangement consists of a first electrode 22, which is positioned opposite the main reflector, and a second electrode 23. Between the tips of these electrodes, the gas discharge 24 is excited in a usual way. The glass bulb 2 and the main reflector 1 are arranged relative to each other such that the gas discharge 24, which represents the actual light source, essentially coincides with the focus of the main reflector.

On the glass bulb 2 is a back reflector 3 in the form of a reflecting layer, which has been deposited on a part of the surface of the glass bulb that surrounds the discharge space. This part of the surface is shaped in such a way that the light emitted from the gas discharge 24 to the back reflector 3 is reflected through the back reflector aperture onto the main reflector 1. The surface is generally spherical.

Various dimension lines have been included in FIG. 1, in order to explain the dimensioning of main reflector 1 and back reflector 3. A first dimension line, denoted L1 and L1', extends from the center of the light source (gas discharge) 24 perpendicularly to the lengthwise direction of the lamp (i. e. the direction of emission) and represents a line of reference. A second dimension line, L2 and L2', extends between the center of the gas discharge 24 and the edge of the back reflector 3 aperture. A third dimension line, L3 and L3', extends between the center of the gas discharge 24 and the edge of the main reflector 1 aperture. Finally, a fourth dimension line, L4 and L4', is drawn between the center of the gas discharge 24 and the end of the back reflector 3 facing away from the main reflector 1.

Accordingly, a first angle a1 (and a1', respectively) is enclosed between the first dimension line L1 (and L1', respectively) and the second dimension line L2 (and L2', respectively), a second angle b1 (and b1', respectively) between the first dimension line L1 (and L1', respectively) and the third dimension line L3 (and L3', respectively), as well as a third angle a2 (and a2', respectively) between the first dimension line L1 (and L1', respectively) and the fourth dimension line L4 (and L4', respectively).

An optimal focusing of emitted light can be achieved by using one and/or several of the following dimensioning guidelines:

To avoid light losses through lateral emission owing to the finite extension of the gas discharge (arc), the first angles a1, a1' should always be smaller than the second angles b1, b1'.

It was also found that the light output is especially good if the first angles a1, a1' are greater than 0. This means that, according to the above definition, the back reflector 3 extends in the direction towards the main reflector not quite as far as halfway the part of the glass bulb that surrounds the discharge space. This prevents in particular any light components emitted by the light source from being reflected several times in the region of the edge of the back reflector 3 aperture without reaching the main reflector 1.

Particularly advantageous properties of the lamp are achieved if the first angles a1, a1' are chosen to be greater than 0 degrees and smaller than approximately 20 degrees, respectively.

This means that a first sector angle L2-L2', which is enclosed between the light source 24 on the one hand and the edge of the back reflector 3 aperture on the other and is therefore, as shown in FIG. 1, the angle between the two dimension lines L2, L2', should be smaller than 180 degrees and preferably greater than approximately 140 degrees. This condition should preferably be satisfied by all sector angles that are obtained by circumscribing the edge of the aperture.

The above dimensioning guidelines hold in particular when the distance between the electrode tips 22, 23 is relatively small as, for example, in short-arc lamps. However, if this distance is greater and the arc therefore longer, it is preferable to dimension the reflectors in a different way.

Figure 2:
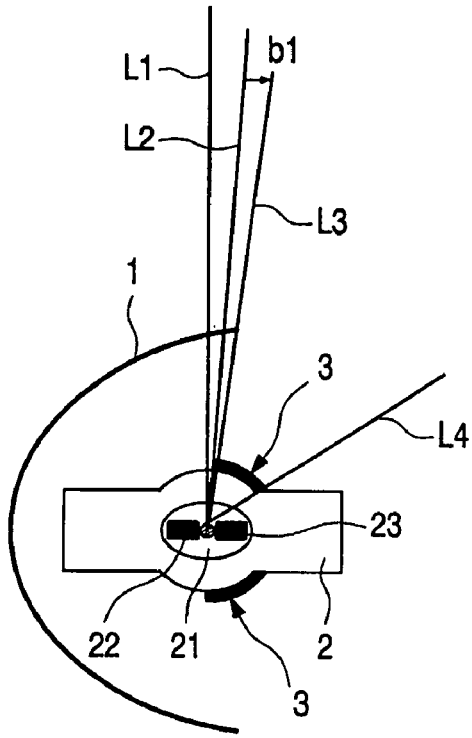
FIG. 2 is a diagrammatic longitudinal sectional view of a second embodiment.

The dimension lines in FIG. 2 should be used for this purpose. Here, the first, third, and fourth dimension lines L1, L3, L4 are identical with the lines of the same name in FIG. 1. However, the second dimension line is here defined by the tip of the second electrode 23 and the edge of the back reflector 3 aperture.

In this case an optimal focusing of the emitted light is achieved if the back reflector 3 extends in the direction towards the main reflector as far as the tip of the second electrode 23. In this case, therefore, the second dimension line L2 is essentially parallel to the first dimension line L1. Moreover, the second angle b1 should again be sufficiently large, so that any lateral light emission is avoided.

For certain applications that make special demands on light focusing, such as, for example, the application in very small displays, it is necessary to consider the whole system consisting of light source, back reflector and main reflector, in order to optimize the efficiency of light emission. The diameter of the main reflector I is usually kept to a minimum, so that angle b1 is not much greater than 0 degrees. In this case and for this particular application, it may be advantageous if the edge of the back reflector 3 aperture extends as far as a point approximately halfway between the tip of the second electrode 23 on the one hand and the midpoint between the two electrode tips 22, 23 on the other.

A preferred common feature of all embodiments therefore is that the glass bulb coating, which forms the back reflector, extends up to a point just short of halfway the glass bulb region surrounding the gas discharge space.

Especially in conjunction with a parabolic reflector as the main reflector 1, it is possible to achieve a high degree of efficiency of light focusing even if the main reflector has a very small diameter, providing the ratio between diameter d and focal length f satisfies the condition d>4f. If, for example, the parabolic reflector has a diameter of approximately 30 mm and a focal length of approximately 6 mm, the use of the back reflector 3 dimensioned as described above on the glass bulb in projection systems will achieve a 30 to 40 percent increase in the efficiency in comparison with a system without back reflector.

It is essential for a lasting increase in this efficiency, and hence for a long service life of the illumination unit, to prevent any blackening of the inside walls of the discharge space. Such a blackening would not only reduce the reflecting power of the back reflector but would also lead to an increased thermal load on the glass bulb owing to the partial absorption of the light emission. A blackening is best prevented by one of the well-known regenerative chemical cycles; the preferred light source is therefore a high-intensity discharge lamp or an ultra high performance lamp. Lamps of this type with back reflector could be used for over a thousand hours without the occurrence of any problems with the electrodes or the glass bulb or, in contrast to known lamps without back reflector, the necessity to make any changes to these parts.

In a preferred embodiment of the illumination unit, a short-arc lamp was chosen with an arc length of less than 2 mm, a wall load greater than 1 $W/mm^2$ and a total power rating of the lamp of between 50 and 1200 W. The discharge gas contained a rare gas such as argon, mercury under high pressure (for example in a quantity of more than approximately 0.15 $mg/mm^3$), and bromine in a quantity of-between approximately 0.001 and approximately 10 $\mu mole/cm^3$, as well as oxygen, so that a tungsten-transport cycle could take place.

Figure 3B:
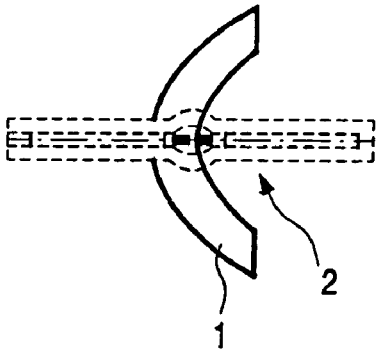
FIG. 3 is a diagrammatic longitudinal sectional view of a third embodiment.
Figure 3A:
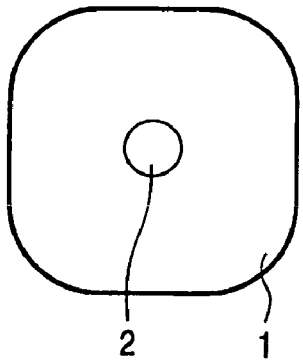
Figure 3C:
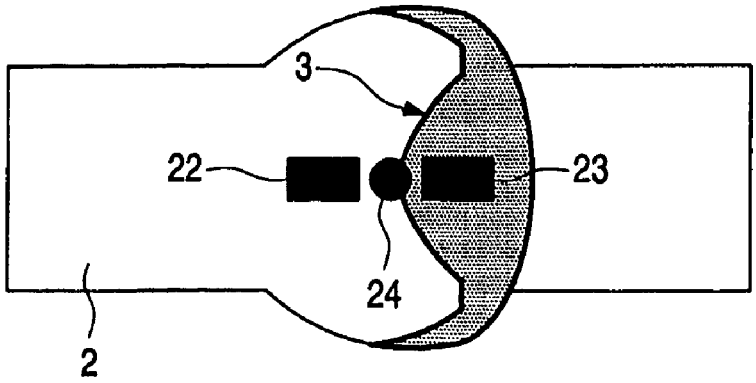

For practical reasons, some projection systems use illumination units with a reflector that is square in plan view. FIG. 3*a* shows such an illumination unit in plan view and FIG. 3*b* in side elevation, where only the reflector 1 and the glass bulb 2 are diagrammatically outlined. For main reflectors of this type, a shape of the back reflector 3 that differs from FIGS. 1 and 2 provides a particularly efficient focusing of the emitted light. This is illustrated in FIG. 3*c*. FIG. 3*c* is a diagrammatic side elevation of the glass bulb 2 with the first and second electrode 22, 23 (the gas discharge 24 is excited between these electrodes) as well as the back reflector 3. In FIG. 3*c*, the edge of the back reflector aperture, which is situated opposite the main reflector (not shown), is preferably determined by the following construction:

Initially a straight line is drawn between the tip of the second electrode 23 and the edge of the main reflector aperture, i. e. its optically active region. Then this line is moved along this edge through 360° around the rotationally symmetrical axis of the glass bulb. The intersection curve, generated in this way by the line and the glass bulb, represents the edge of the back reflector aperture in a shape preferred for optimal efficiency. Put differently, this edge is generated on the glass bulb by a projection of the main reflector edge along a funnel-like surface that starts from the tip of the second electrode.

It should be pointed out that the shape of the optimum edge of the coating, which is intended to act as a reflector, is obtained from the position of the electrodes and the position of the main reflector, not from the position of the glass bulb. For certain applications, such as the ones mentioned above by way of example, it may be advantageous to determine said edge of the back reflector aperture by drawing the line from a point on the connecting line between the two electrodes 22, 23, rather than from the tip of the electrode 23. However, this point will in any case be closer to the second (front) electrode 23 than to the first electrode 22. FIG. 3*c* shows the back reflector, and in particular the edge delimiting its aperture which is obtained if the above instructions are carried out for a main reflector as shown in FIG. 3, which has an essentially square shape in plan view.

Another point that should be noted in view of the increase in optical performance capability is the geometric dimensioning of the glass bulb and in particular of the region surrounding the gas discharge space. This is particularly relevant for the so-called short-arc lamps. Their high gas pressure necessitates relatively thick walls that may act as lenses and could disturb the image of the arc that is reflected back onto the main reflector.

Figure 4:
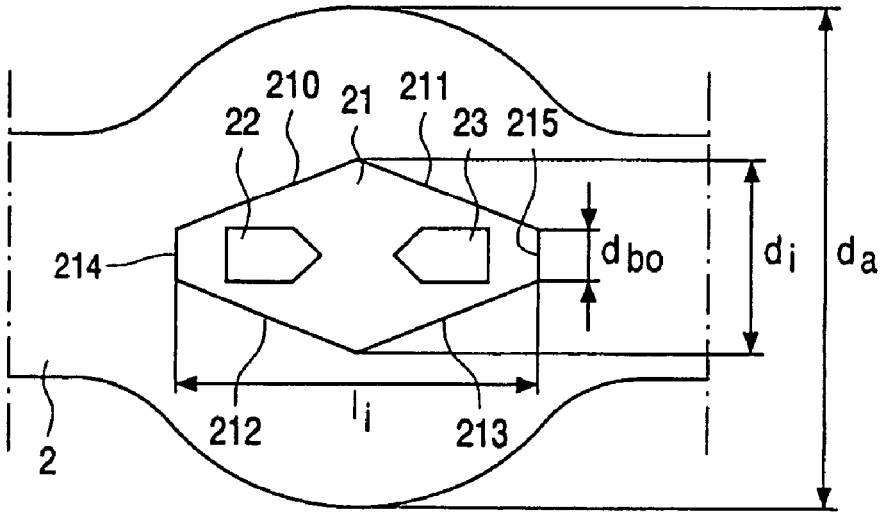
FIG. 4 is a diagrammatic longitudinal sectional view of a fourth embodiment.

FIG. 4 diagrammatically shows the central region of the glass bulb in side elevation, including a simplified representation of the gas discharge space 21 that contains the electrode arrangement 22, 23. The longitudinal section of the gas discharge space is essentially ellipse-shaped; it is approximated in lengthwise direction by wall sections 210, 211, 212, 213 as well as two end walls 214, 215. It was found that particularly advantageous optical properties can be achieved if the inclination s of the wall sections, which is approximately equal to the difference between the greatest ($d_i$) and the smallest ($d_{bo}$) inside diameter of the gas discharge space divided by its length ($l_i$), is set to a value s in a range of between 0.3 and 0.8.

The external shape of the glass bulb surrounding the gas discharge space 21 should essentially be a sphere or of an ellipsoid. In the case of the sphere, the arc should be positioned at the center of the sphere. In the case of the ellipsoid, the focal distance should not exceed the distance between the two electrode tips 22, 23, and the focal points should lie inside the arc.

The glass bulb was also found to reach a higher temperature with a coating having a reflecting layer than without such a coating. This increase in temperature not only necessitates increased durability and stability of the reflecting coating, but also causes an accelerated detrimental change in the glass bulb, or rather in the quartz material the glass bulb is made of. These changes may, on the one hand, consist of a re-crystallization of the inner wall of the gas discharge space and, on the other hand, even result in a deformation of the bulb owing to the high gas pressure in this space.

It was surprisingly found that these problems can be largely solved by slightly increasing the outside diameter ($d_a$) of the glass bulb in the region of the gas discharge space. If, for example, the outer diameter of a glass bulb with a reflecting coating is increased by approximately 10 percent compared with a glass bulb for a discharge lamp with the same power and without coating, then both lamps will have essentially the same temperature and the same length of service life. The same result is obtained if the outer diameter is increased by approximately 5 to 15 percent.

As to the type of back reflector, it has proved advantageous to use dichroic reflecting coatings, which can be deposited on the glass bulb, for example by using a sputtering process.

If the back reflector is implemented with interference filters, at least two materials are needed with a high and a low refractive index, respectively. In order to achieve a good filter effect, the absolute difference between the refractive indices of the two materials should be as great as possible.

Another important parameter in selecting the materials is the thermal expansion coefficient. In order to prevent high mechanical stresses, this expansion coefficient should largely match that of the base material, which in general is the material the glass bulb is made of. Moreover, these materials should have sufficient temperature stability, especially if they are deposited on an UHP lamp (900–1000° C.).

The preferred material with the low refractive index is silicon dioxide ($SiO_2$), which is also the material the glass bulb is made of. The material with high refractive index may be chosen from the following and other materials: $TiO_2$, $ZrO_2$, $Ta_2O_5$.

$TiO_2$ is a very good optical material with a very high refractive index, but also a very high thermal expansion coefficient. For the usual deposition processes, $TiO_2$ is used in the form of anatase, a crystallographic modification. At temperatures above 650° C., $TiO_2$ is transformed into the rutile modification, which has a greater density. This can cause additional stresses in the layers, so that the use of $TiO_2$ is normally restricted to temperatures that lie considerably below the operating temperatures of UHP lamps. However, a possible solution consists in depositing $TiO_2$ directly in rutile form as a first step. For example, the Leybold Company's TwinMag process could be used for this purpose. A stabilization of the filter may be carried out in a second step, which is described below with reference to $ZrO_2$.

$ZrO_2$ is an optical material with a medium refractive index, whose optical properties at high temperatures are very stable. However, it also has a very high thermal expansion coefficient. Since the base material generally has a much lower thermal expansion coefficient, the filter stacks can develop cracks. However, these cracks can be largely avoided by applying a coating of silica (see WO 98/23897) to the filter stack, so that the stresses are at least partly compensated for. This procedure is also possible in the case of the application of $TiO_2$ described above.

Finally $Ta_2O_5$ is a good optical material with a high refractive index and a medium thermal expansion coefficient. The degree of mismatch to the thermal expansion coefficient is so slight that filter stacks are stable even when used for UHP lamps. After a long operating period (several hundred hours, for example, but before the end of lamp life), the layers take on a whitish appearance so that the optical properties can deteriorate owing to diffusion. This can be overcome by modifying the construction of the lamp in such a way that the temperature of the layers is reduced to a level at which the layers keep their optical properties throughout lamp life.

In addition, it is possible to create new materials with optimized properties by mixing two or more of the known coating materials. Such materials and a dip-coating procedure for filters are known from U.S. Pat. No. 4,940,636 and the paper by H. Köstlin et al. "Optical filters on linear halogen-lamps prepared by dip-coating" in the Journal of Non-Crystalline Solids 218, 1997, pp. 347–353, respectively, which are to be regarded as included in the present disclosure by reference. In particular a mixture of $TiO_2$ and $Ta_2O_5$ has a good thermal stability up to a temperature of about 1000° C., which is generally sufficient for UHP lamps. However, since dip-coating can cause problems in the case of relatively small ellipse-shaped UHP lamps, sputtering is usually the preferred coating process.

Apart from the above mentioned materials and mixtures of materials, there is a large number of further materials and their mixtures that can be used and can be determined by experiment.

The illumination unit according to invention is particularly suitable for use in projection systems, for example for displays.

The invention claimed is:

1. An illumination unit having a light source, a main reflector and a back reflector with an aperture opposite the main reflector, through which aperture light is reflected from the light source onto the main reflector, wherein a center of the light source and the back reflector are located or shaped relative to each other such that a first sector angle enclosed between the center of the light source and an edge of the aperture of the back reflector is smaller than 180°, the aperture of the back reflector being non-circular, wherein the center of the light source is located between two electrodes, the edge including a receding portion and an advancing portion, and wherein the advancing portion partially surrounds the center of the light source.

2. The illumination unit as claimed in claim 1, wherein the light source and the back reflector are located or shaped relative to each other such that the light source lies outside a plane defined by the edge of the aperture of the back reflector.

3. The illumination unit as claimed in claim 1, wherein the back reflector is deposited on a spherical surface, and the first sector angle has a value of at least approximately 140°.

4. The illumination unit as claimed in claim 1, wherein a second sector angle, enclosed between the light source and an edge of an aperture of the main reflector has a value greater than or equal to the difference between 360° and the value of the first sector angle of the back reflector.

5. The illumination unit as claimed in claim 1, wherein a ratio between a diameter d and a focal length f of the main reflector satisfies the condition d>4f.

6. The illumination unit as claimed in claim 1, wherein the light source consists of a high-pressure gas discharge lamp with an arc length of less than approximately 2 mm, whose discharge gas contains a rare gas, mercury under high pressure, and bromine in a quantity between approximately 0.001 and approximately 10 μmole/cm3, as well as oxygen, while the back reflector consists of a reflecting coating deposited on the glass bulb of the gas discharge lamp.

7. The illumination unit as claimed in claim 6, wherein a shape of the edge of the aperture of the back reflector is a projection of an edge of an aperture of the main reflector in a direction of the light source onto the glass bulb of the gas discharge lamp.

8. The illumination unit as claimed in claim 6, wherein the gas discharge space has essentially an ellipsoidal shape, with wall sections whose inclinations have values between approximately 0.3 and approximately 0.8.

9. The illumination unit as claimed in claim 6, wherein the glass bulb in the region surrounding the gas discharge space has an outside diameter which is approximately 5 to 15 percent greater than that of a glass bulb without back reflector so as to prevent an increase in the temperature of the glass bulb caused in particular by the back reflector.

10. The illumination unit as claimed in claim 6, wherein the reflecting coating is dichroically reflecting.

11. The illumination unit as claimed in claim 10, wherein the reflecting coating is formed by an interference filter comprising a first material with a low refractive index and a second material with a high refractive index.

12. The illumination unit as claimed in claim 11, wherein the first material is SiO2.

13. The illumination unit as claimed in claim 11, wherein the second material is TiO2 and/or ZrO2 and/or Ta2O5.

14. A projection system with at least one illumination unit as claimed in claim 1.

15. The illumination unit of claim 1, wherein the aperture includes at least one indentation.

16. The lighting device of claim 1, wherein the advancing portion extends beyond the center of the light source.

17. The lighting device of claim 1, wherein the receding portion does not surround the center of the light source.

18. A lighting device comprising:

a light source configured to produce a light;

a main reflector; and a back reflector for reflecting said light to said main reflector, said back reflector having a non-uniform aperture through which light from the light source is reflected from said back reflector to the main reflector, wherein a center of the light source is located between two electrodes, an edge of the non-uniform aperture including a receding portion and an advancing portion, and wherein the advancing portion partially surrounds the center of the light source.

19. The lighting device of claim 18, wherein the non-uniform aperture includes at least one indentation nearest to the main reflector.

20. The lighting device of claim 18, wherein a ratio between a diameter d and a focal length f of the main reflector satisfies a condition d>4f.

21. The lighting device of claim 18, wherein the light source includes a high-pressure gas discharge lamp with an arc length of less than approximately 2 mm, having a discharge gas that includes a rare gas, mercury under high pressure, and bromine in a quantity between approximately 0.001 and approximately 10 μmole/cm3, and oxygen.

22. The lighting device of claim 18, wherein the back reflector includes a reflecting coating deposited on an envelope of the light source, the reflecting coating being dichroically reflecting.

23. A lighting device comprising:

a light source configured to produce a light;

a main reflector; and a back reflector for reflecting said light to the main reflector, wherein a first portion of the back reflector is outside the main reflector and a second portion of the back reflector is inside the main reflector, wherein a center of the light source is located between two electrodes, an edge of the back reflector including of a receding portion and an advancing portion, and wherein the advancing portion partially surrounds the center of the light source.

24. A lighting device of claim 23 wherein the back reflector has a non-uniform aperture through which light from the light source is reflected from the back reflector to the main reflector.

25. A lighting device comprising:

a light source having an outer envelope;

a main reflector; and a back reflector located on a portion of the outer envelope for reflecting light from the light source to the main reflector, wherein a peripheral edge of the back reflector over the outer envelope nearest to the main reflector includes of a receding portion and an advancing portion, wherein a center of the light source is located between two electrodes, and wherein the advancing portion partially surrounds the center of the light source.

* * * * *